US007987787B1

(12) United States Patent
Sudick

(10) Patent No.: US 7,987,787 B1
(45) Date of Patent: Aug. 2, 2011

(54) ELECTRONIC IGNITION SAFETY DEVICE CONFIGURED TO REJECT SIGNALS BELOW A PREDETERMINED 'ALL-FIRE VOLTAGE'

(75) Inventor: John A. Sudick, Saugus, CA (US)

(73) Assignee: Ensign-Bickford Aerospace & Defense Company, Simsbury, CT (US)

( * ) Notice: Subject to any disclaimer, the term of this patent is extended or adjusted under 35 U.S.C. 154(b) by 1109 days.

(21) Appl. No.: 11/715,106

(22) Filed: Mar. 7, 2007

(51) Int. Cl.
*F42B 3/18* (2006.01)
*F42C 15/00* (2006.01)

(52) U.S. Cl. ..... 102/202.1; 102/202.7; 102/206; 102/215; 102/221

(58) Field of Classification Search ..... 102/202.1, 102/202.7, 481, 206, 215, 221
See application file for complete search history.

(56) References Cited

U.S. PATENT DOCUMENTS 3,209,692 A * 10/1965 Webb ..... 102/275.4
3,238,876 A * 3/1966 Allen ..... 102/275.4
3,945,322 A 3/1976 Carlson et al. ..... 102/70 R
3,978,791 A * 9/1976 Lemley et al. ..... 102/202.14
3,982,488 A * 9/1976 Rakowsky et al. ..... 102/205
4,592,281 A * 6/1986 Nagennast ..... 102/254
4,608,926 A * 9/1986 Stevens ..... 102/275.4
4,653,400 A * 3/1987 Crawford ..... 102/202
4,735,145 A 4/1988 Johnson et al. ..... 102/202.5
5,279,226 A 1/1994 Ritchie et al. ..... 102/254
5,959,236 A 9/1999 Smith et al. ..... 102/204
6,923,122 B2 8/2005 Hennings et al. ..... 102/202.7

OTHER PUBLICATIONS

"Ordnance Sessions—AIAA 34th Joint Propulsion Conference, Jul. 13-16, 1998 / Cleveland, Ohio" (Special Devices, Inc. 1998, published by AIAA as Pub. No. 98-3627) (Figs. 3-4).

* cited by examiner

*Primary Examiner* — James S Bergin
(74) *Attorney, Agent, or Firm* — Cantor Colburn LLP

(57) ABSTRACT

An electronic ignition safety device configured to reject signals below a predetermined 'all-fire' voltage comprising an exploding foil initiator having an electrical input and an output end, a pickup comprising a secondary explosive donor charge adjacent to the exploding foil initiator's output end and separated from a secondary explosive acceptor charge by an integral barrier, and an output charge adjacent to the acceptor charge.

14 Claims, 2 Drawing Sheets

ELECTRONIC IGNITION SAFETY DEVICE CONFIGURED TO REJECT SIGNALS BELOW A PREDETERMINED 'ALL-FIRE VOLTAGE'

FIELD OF THE INVENTION

The present invention relates primarily to the field of electronic ignition safety devices, and more particularly, to an electronic safe, arm, and fire device configured to reject signals below a predetermined 'all-fire' voltage.

BACKGROUND. OF THE INVENTION

While various electronic ignition safety devices exist, there is a need for an electronic ignition safety device that is suitable for use in applications such as rocket motors, but that can be configured to meet applicable U.S. military standards (e.g., MIL-STD-1316 and MIL-STD-1901) without requiring a safety mechanism that relies upon moving parts.

SUMMARY OF THE INVENTION

An electronic ignition safety device configured to reject signals below a predetermined 'all-fire' voltage according to an embodiment of the present invention comprises an exploding foil initiator having an electrical input and an output end, a pickup comprising a secondary explosive donor charge adjacent to the exploding foil initiator's output end and separated from a secondary explosive acceptor charge by an integral barrier, and an output charge adjacent to the acceptor charge.

DETAILED DESCRIPTION OF A PREFERRED EMBODIMENT

Figure 1:
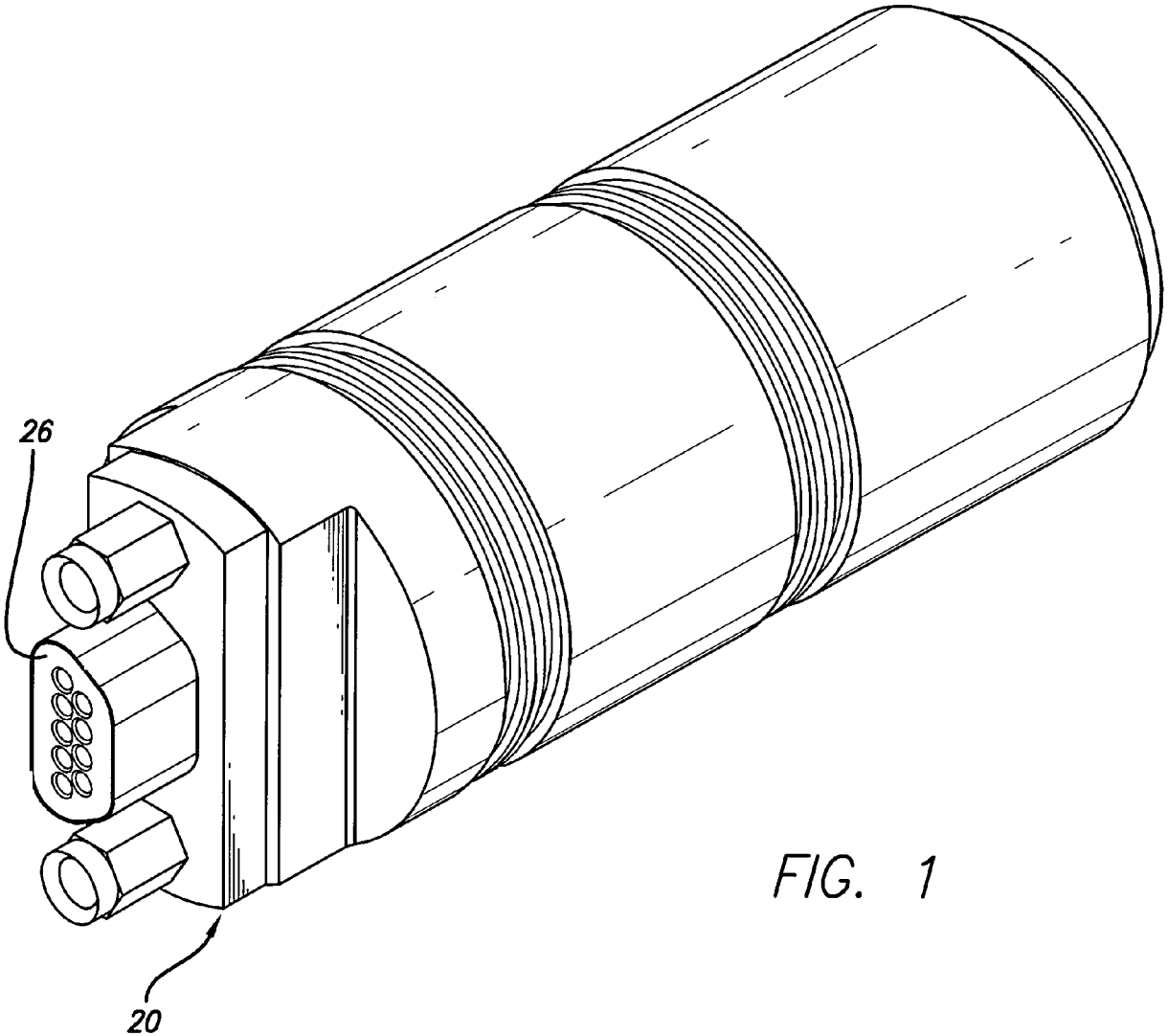
FIG. 1 is a perspective view of a preferred embodiment of an electronic ignition safety device configured to reject signals below a predetermined 'all-fire' voltage according to the present invention.
Figure 2:
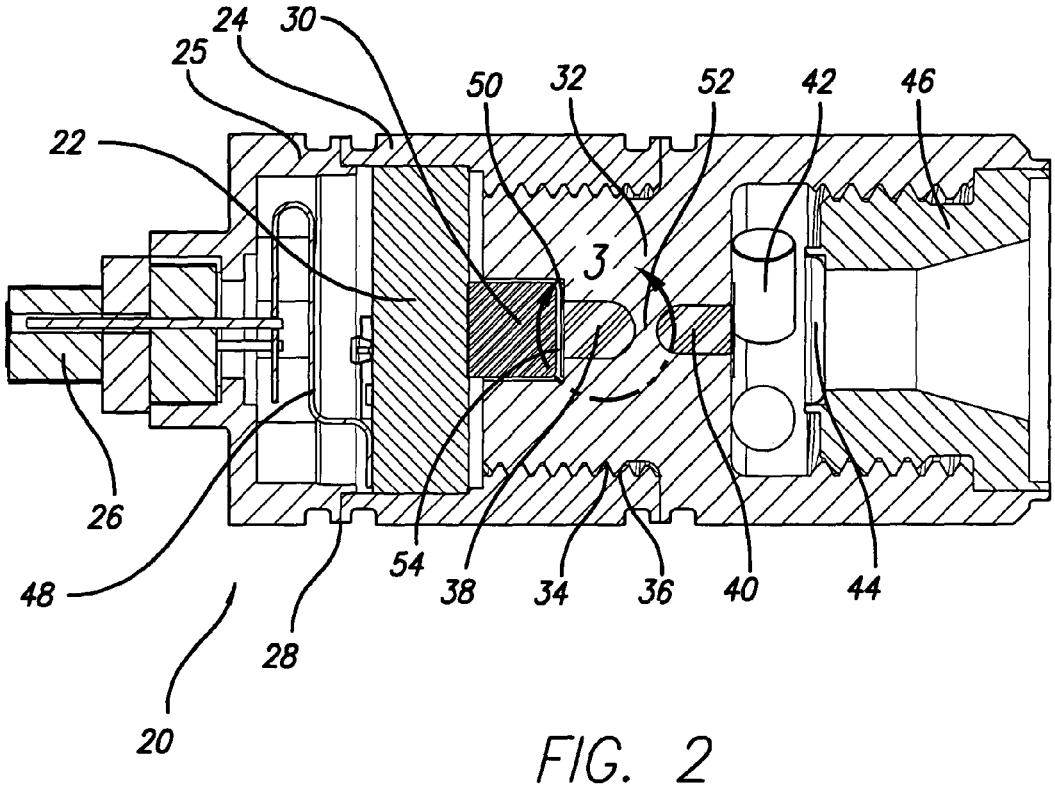
FIG. 2 is a longitudinal sectional view of the embodiment shown in FIG. 1.
Figure 3:
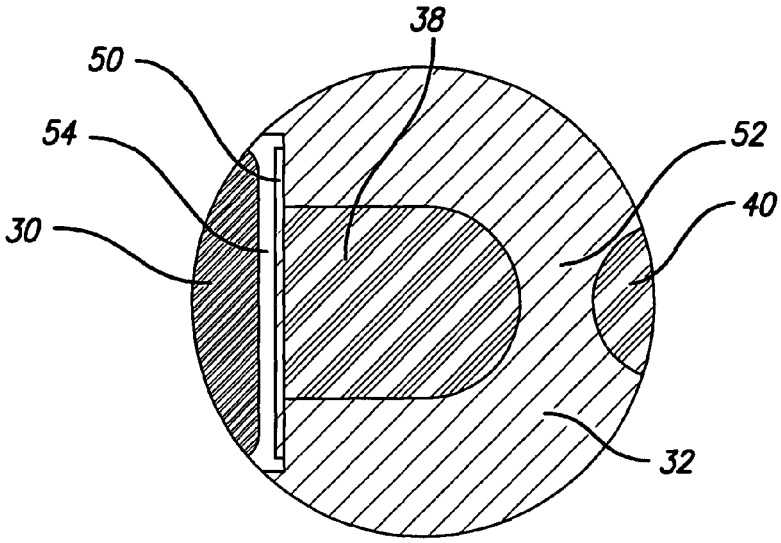
FIG. 3 is a close-up view of the 'pickup' section shown in FIG. 2.

FIGS. 1-3 depict a preferred embodiment of an electronic ignition safety device configured to reject signals below a predetermined 'all-fire' voltage—more particularly, an electronic safe, arm, and fire device ("ESAF device") 20—according to the present invention. As seen in FIG. 1, the ESAF device 20 (having a 2.051" length in the illustrated embodiment) includes a standard electrical connector 26 at one end. As seen in FIG. 2, the electrical connector 26 is secured to a housing endpiece 25, and electrical attachments 48 extend from the electrical connector 26 to a fireset 22 (the internal contents of which are not illustrated for simplicity). The fireset 22 accepts power, ground, ARM signal, and FIRE signal from weapon control electronics (not shown) connected to the ESAF device 20, and provides a SAFE-ARM electrical indication based on the voltage on a firing capacitor within the fireset 22. The fireset 22 also preferably includes a DC-DC converter that steps up the input voltage (normally in the 28V DC range) to a predetermined voltage preferably greater than 500V, and preferably includes electronic switches that maintain a zero voltage on the fireset's firing capacitor until a proper ARM signal is received. The fireset 22 is configured to charge the firing capacitor to a minimum of a predetermined 'all-fire' voltage in response to receipt of a proper ARM signal, and to close an electronic switch discharging the firing capacitor into the EFI 30 (described below) within a predetermined delay after subsequent receipt of a proper FIRE signal.

A housing receiver 24 is joined at a circumferential weld 28 to the housing endpiece 25, over the fireset 22, and is provided internally with female threads 36. The housing endpiece 25 and housing receiver 24 are preferably machined from stainless steel, although other materials might be used such as aluminum. Secured atop and electrically connected to output terminals (not shown) of the fireset 22 is an exploding foil initiator (EFI) 30. The EFI 30 preferably comprises (details not illustrated) a miniature circuit board made from an epoxy/fiberglass base, a copper bridge, a kapton layer that serves as a flyer plate, and a barrel and explosive charge (a secondary explosive such as HNS-IV) attached to the kapton layer and contained within a thin-walled drawn stainless steel cup. When the fireset 22 applies an adequate voltage of suitable waveform to the EFI 30, the copper bridge explodes, shearing and accelerating the kapton flyer plate along the barrel and into the explosive charge, causing it to detonate.

Atop the fireset 22 and EFI 30, a through-bulkhead initiator (TBI) body 32 (having a 0.75" outermost diameter in the illustrated embodiment) is preferably secured to housing receiver 24 by circumferential welding after fully engaging male threads 34 on the TBI body 32 into the female threads 36 of the housing receiver 24, and preferably hermetically seals a rocket motor firing chamber to which it attaches (through external features not shown). The TBI body 32 is preferably precision-machined of stainless steel, with a pickup section that includes an integral barrier configured to propagate a shock wave. Referring to FIG. 3, the pickup section includes a donor charge 38 (having a 0.111" diameter and 0.14" length in the illustrated embodiment) that is set within a first cavity in the TBI body 32 aligned with the output end of the EFI 30 and hermetically covered with a foil seal 50, an integral barrier 52 (having a 0.043" length in the illustrated embodiment), and an acceptor charge 40 (having a 0.093" diameter and 0.147" length in the illustrated embodiment) that is set within a second cavity in the TBI body 32 and hermetically covered with another foil seal. The donor charge 38 and acceptor charge 40 are made from compressed secondary explosives such as CH-6, RDX or PBXN-5, and the pickup section is designed so as to allow a shock wave sufficient to detonate the acceptor charge while maintaining structural integrity, as is known in the art. Likewise, the TBI body 32 is preferably configured such that there is a small gap 54 (primarily based upon the particular EFI chosen—e.g., approximately 0.010" in the embodiment illustrated) between the output end of the EFI 30 and the foil seal 50, in order to facilitate reliable propagation of the detonating output from the EFI 30 to the donor charge 38.

Atop the foil seal overlaying the acceptor charge 40 is an output charge 42 (formed, e.g., as pellets, powder, granules, etc.) made of an igniter material such as BKNO3 and covered by a thin metallic sealing closure 44. Atop the sealing closure 44, an output port 46 is screwed into the end of the TBI body 32. Propagation from the acceptor charge 40 ignites the output charge 42, and the resulting output can be used to ignite, e.g., a rocket motor propellant either directly or through a booster igniter.

The EFI 30 only produces a high-order detonation in response to voltage at or above a high 'all-fire' voltage preferably in excess of 500V. In the event of an inadvertent low voltage signal from the fireset 22, the EFI 30 would at most produce a low energy or low-order deflagrating output; even if that deflagration causes the donor charge 38 (which is a secondary explosive) to burn, a shock wave of sufficient energy would not be produced to initiate the acceptor charge 40, so the output charge 42 would not be initiated. Thus, the combination of an EFI in line with a TBI pickup/barrier results in a device that cannot produce an output below the EFI's voltage, yet does not require a safety mechanism that relies upon moving parts.

Although the present invention has been described in detail in the context of a preferred embodiment for use in applications such as rocket motors, one skilled in the art will appreciate that numerous variations, modifications, and other applications are also within the scope of the present invention. For example, dual, parallel firesets, EFIs, and pickup sections could be provided in a single housing, for redundancy. Further, although an embodiment of the invention for use with a rocket motor has been described, the invention could be used in other applications such as gas generators, cartridge-actuated devices, and/or propellant-actuated devices. Thus, the foregoing detailed description is not intended to limit the invention in any way, which is limited only by the following claims and their legal equivalents.

What is claimed is:

1. An electronic ignition safety device configured to reject signals below a predetermined "all-fire' voltage, comprising:

a) an exploding foil initiator having an electrical input and an output end;

b) an electronic fireset electrically connected to said electrical input of said exploding foil initiator;

c) a pickup comprising:

i. a donor charge adjacent said output end of said exploding foil initiator and comprising a secondary explosive;

ii. an acceptor charge comprising a secondary explosive; and iii. an integral barrier between said donor charge and said acceptor charge;

d) an output charge adjacent said acceptor charge;

e) a Through Bulkhead Initiator (TBI) body, wherein said integral barrier is part of said TBI body; and f) wherein said donor charge and said acceptor charge are each contained within cavities defined within said TBI body, and wherein said donor charge and said acceptor charge are hermetically sealed.

2. The device of claim 1, wherein said exploding foil initiator is configured to detonate in response to a signal only if the signal exceeds a predetermined voltage, wherein said predetermined voltage is at least 500V.

3. The device of claim 1, further comprising an electrical connector electrically connected to said electronic fireset.

4. The device of claim 1, further comprising a sealing closure adjacent said output charge, and an output port.

5. The device of claim 1, further comprising a gap between said output end of said exploding foil initiator and said donor charge.

6. The device of claim 1, wherein said device is an electronic safe, arm, and fire device.

7. The device of claim 6, wherein said device is configured to initiate a rocket motor.

8. An electronic ignition safety device configured to reject signals below a predetermined 'all-fire' voltage, comprising:

a) an exploding foil initiator having an electrical input and an output end;

b) an electronic fireset electrically connected to said electrical input of said exploding foil initiator;

c) an output charge;

d) a pickup means for propagating detonation, but not deflagration, of said exploding foil initiator to said output charge;

e) a pickup means includes a Through Bulkhead Initiator (TBI) body and a donor charge separated from an acceptor charge by an integral barrier; and f) wherein said donor charge and said acceptor charge are each contained within cavities defined within said TBI body, and wherein said donor charge and said acceptor charge are hermetically sealed.

9. The device of claim 8, wherein said exploding foil initiator is configured to detonate in response to a signal only if the signal exceeds a predetermined voltage, wherein said predetermined voltage is at least 500V.

10. The device of claim 8, further comprising an electrical connector electrically connected to said fireset.

11. The device of claim 8, further comprising a sealing closure adjacent said output charge, and an output port.

12. The device of claim 8, further comprising a gap between said output end of said exploding foil initiator and said donor charge.

13. The device of claim 8, wherein said device is an electronic safe, arm, and fire device.

14. The device of claim 13, wherein said device is configured to initiate a rocket motor.

* * * * *